United States Patent [19]

Morita

[11] Patent Number: 4,915,678

[45] Date of Patent: Apr. 10, 1990

[54] BOX FORMING EQUIPMENT

[75] Inventor: Shigeru Morita, Iruma, Japan

[73] Assignee: Nippon Flute Co., Ltd., Irumagun, Japan

[21] Appl. No.: 224,843

[22] Filed: Jul. 27, 1988

[30] Foreign Application Priority Data

Jul. 27, 1987 [JP] Japan ..... 62-114873[U]

[51] Int. Cl.[4] ..... B31B 1/76; B31B 1/60

[52] U.S. Cl. ..... 493/116; 493/124; 493/183; 493/313; 493/453

[58] Field of Search ..... 493/116, 122, 123, 124, 493/125, 126, 127, 183, 453, 310, 313, 316

[56] References Cited

U.S. PATENT DOCUMENTS 4,213,285 7/1980 Mancini ..... 493/116

4,414,789 11/1983 Pattarozzi ..... 493/316

4,632,666 12/1986 Ulrich ..... 493/316

*Primary Examiner*—Frederick R. Schmidt

*Assistant Examiner*—Jack W. Lavinder

*Attorney, Agent, or Firm*—Bradford E. Kile

[57] ABSTRACT

A preferred embodiment of the invention comprises a box forming machine operable to raise folded box material to a box frame, and to fold the edges that comprise the box bottom into a bottom area and to tape the folded edges. The forming equipment is equipped with a box material supply that stores folded box stock material. The apparatus withdraws a piece of box material from the box material supply station by means of a vacuum chuck. The box stock material is raised to a box frame by means of a raise guide and further to a bottom folding station that folds the inner box edges which extend in a direction transverse to a taping direction. Outer edges are then folded into the bottom areas along the taping direction and a tape head tapes together the inner edges by means of a tape head drive.

7 Claims, 5 Drawing Sheets

BOX FORMING EQUIPMENT

BACKGROUND OF THE INVENTION

The invention relates to box forming equipment. More specifically, this invention relates to a box material which is folded into a box frame, compact box forming equipment which automatically produces a closed end box.

In the past making a box has been achieved by removing a folded box blank from material stored at a box material supply station and raiseing the box material to a box frame. Next edges are filed that comprise the box bottom into a bottom area. The folded box material is then convened to a tape head which then adheres a tape onto the edges that are folded into the box bottom area during transfer of the box material.

Although such box forming equipment has been utilized with some success, the total size of the equipment becomes large in existing devices. In this connection, movement of the box material transfer is large when the box material is raised to a box frame and the edges are folded into the box bottom area then the box material is moved to the tape head to be taped. In essence, the whole equipment can become large, costly and cubmersome since the box material is transferred, as explanded, to a box frame with a large volume.

The difficulties suggested in the preceding are not intended to be exhaustive, but rather are among many which may tend to reduce the effectiveness and satisfaction with prior box forming machines. Other noteworthy problems may also exist; however, those presented above should be sufficient to demonstrate that appearing in the past will admit to worthwhile improvement.

OBJECTS AND BRIEF SUMMARY OF THE INVENTION

Objects

It is therefore a general object of the invention to provide a novel box forming apparatus which will obviate or minimize difficulties of the type previously described.

It is a specific object of the invention to provide box forming equipment which is compact and efficient in design and operation.

It is another object of the invention to provide box forming equipment which is relatively inexpensive to produce.

It is a further object of the invention to provide box forming equipment which is operable to form a paperboard box with a closed bottom in a condition for subsequent use.

Brief Summary of a Preferred Embodiment

A preferred embodiment of the invention which is intended to accomplish the foregoing objects comprises a box forming machine operable to raise folded box material to a box frame, and, to fold the edges that comprise the box bottom into a bottom area and to tape the folded edges. The forming equipment is equipped with a box material supply that stores folded box stock material. The subject apparatus withdraws a piece of box material 1 from the box material supply station by means of a vacuum chuck. The box stock material is raised to a box frame by means of a raise guide and further to a bottom folding station that folds inner box edges which extend in a direction transverse to a taping direction. Outer edges are then folded into the bottom area along the taping direction and a tape head tapes together the inner edges by means of a tape head drive.

THE DRAWINGS

Other objects and advantages of the present invention will become apparent from the following detailed description of a preferred embodiment thereof taken in conjunction with the accompanying drawings, wherein:

FIGS. 1(*a*)–(*e*) are a sequence of axonometric views of a paperboard box with the bottom formed and closed with tape in accordance with compact box forming equipment according to the subject invention;

DETAIL DESCRIPTION

Context of the Invention

Prior to providing a detailed description of the subject invention, reference to the context of the subject invention may be worthwile. In this connection, FIGS. 1(*a*)–(*e*) disclosed box stock material 1. The box material 1 comprises a corrugated box board. The box material has pairs of side boards 2*a*, 2*b* that form the side panels of the box. Each side board 2*a*, 2*b* has extensions 3*a*, 3*b* which operably form an upper lid on the upper edges of the side boards 2*a*, 2*b*. Each side board has an inner folded bottom panel 4*a*, and an outer folded bottom panel 4*b* on a lower edge of side boards 2*a* and 2*b* respectively to form the box bottom. Each side board 2*a* and 2*b* is suitable to be folded along folding lines 6 and 7 to produce top panels 3*a* and 3*b* and bottom panels 4*a* and 4*b*.

Figure 1:
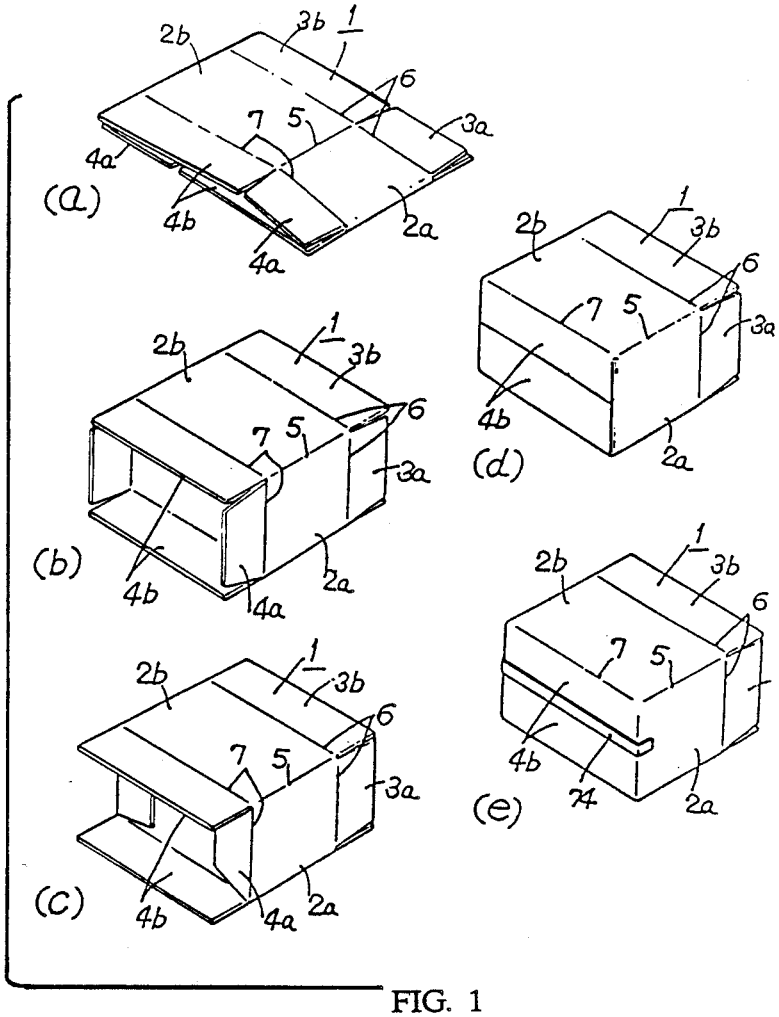

Once the bottom panels 4*a* and 4*b* are folded into position, a tape 74 and/or glue is utilized to retain the bottom in a formed condition, note FIG. 1(*e*).

Box Forming Equipment Structure

Turning now to FIGS. 2 through 5 wherein like reference numerals indicate like parts, box forming equipment 11 is shown in accordance with a preferred embodiment of the invention. The box forming equipment has a mechanical body frame 12 which is constructed from L-shaped steel to form a perpendicular frame. The box forming equipment is moved by means of casters 13 that are installed on four corners of the body frame 12.

Figure 2:
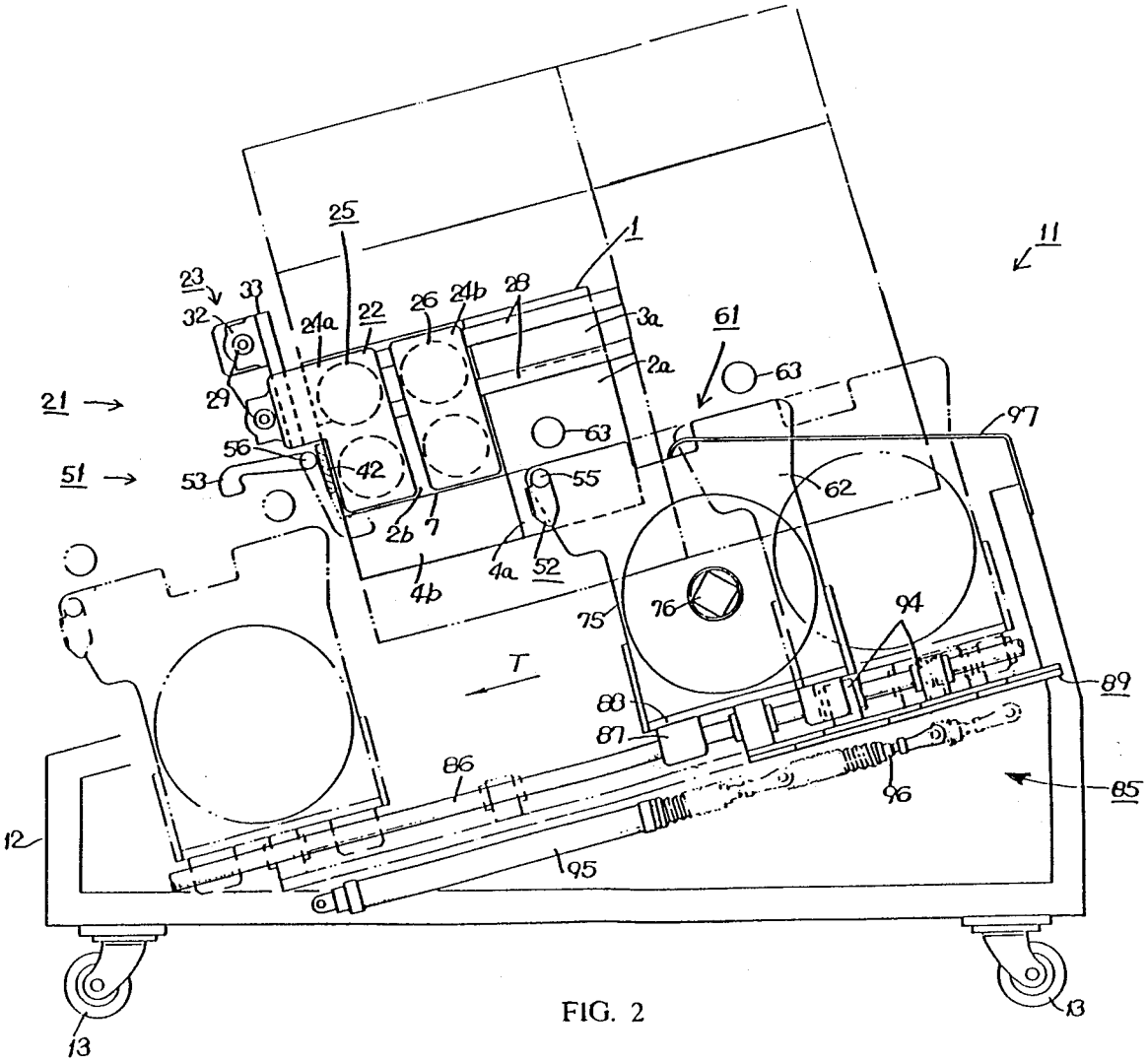
FIG. 2 is a front view of a preferred embodiment of the subject box forming equipment.
Figure 3:
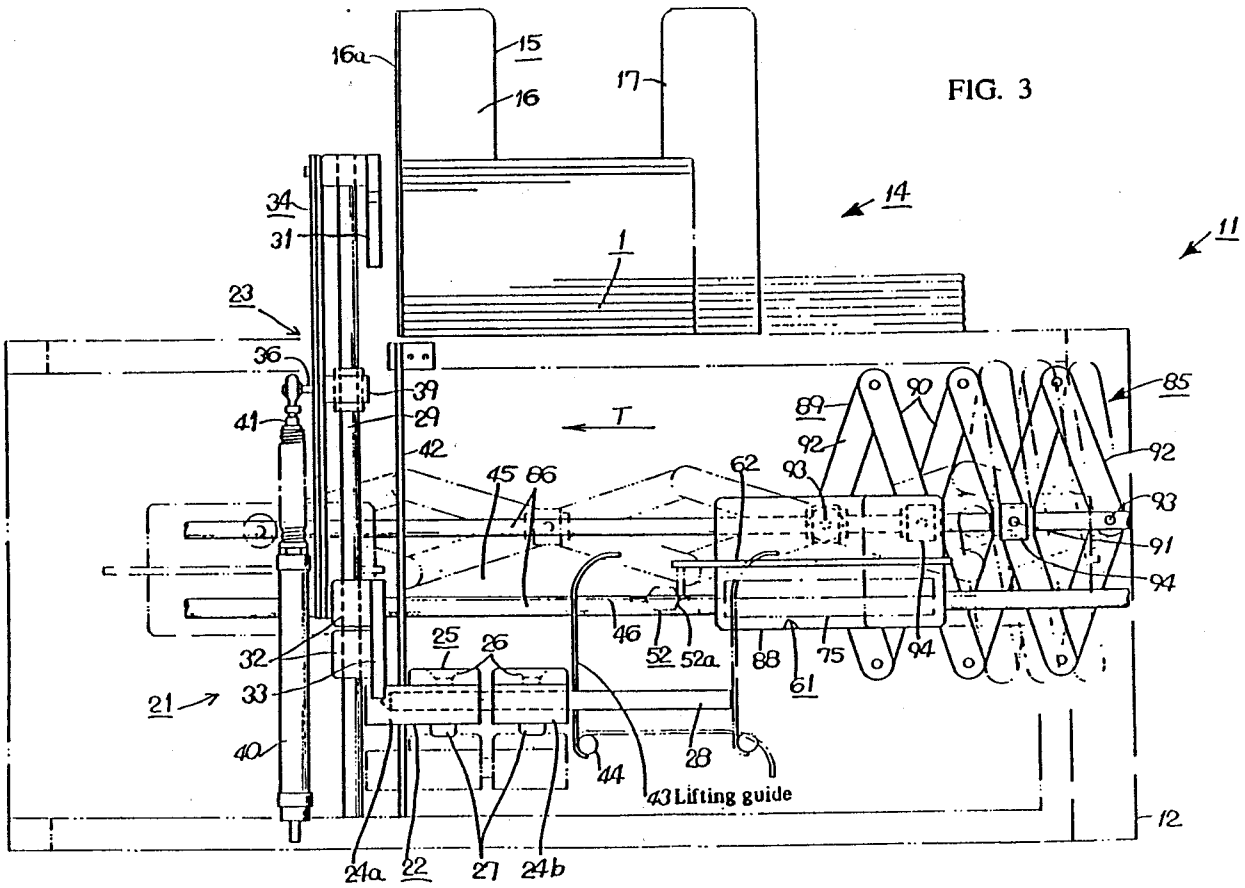
FIG. 3 is a top view of the box forming equipment depicted in FIG. 2.

A box material supply part 14, note FIG. 3, is installed on an upper back part of the mechanical body frame 12. The box material supply part 14 includes a hopper 15 which the box materials 1. The hopper has a pair of bottom guide plates 16 and 17 that raise from a back part of the mechanical body frame 12. A side plate 16*a* is installed at a right angle onto the left side edge of the bottom plate 16 when viewed from a horizontal plane in FIG. 3. The bottom plates 16 and 17 are slant to the left side note FIG. 2. The plates 16 and 17 are also slanted forward in the direction of the mechanical body 12 with an angle of about 25°, noted FIG. 4.

Folded box materials 1 are stored in a forward and backward direction in the hopper 15, to position each folded box 1 by means of the slant of the bottom plates 16 and 17. The box stock material 1 is, therefore, supplied by gravity against the back of the mechanical body frame 12. The hopper is equipped with a stopper, not shown, which stops the extreme front box member to enable the machine to remove a box from the front of the hopper.

The hopper 15 is equipped with an up and down adjustment mechanism which provides vertical adjustment of position of the hopper 15 according to size variation of the box stock material 1. According the position of the box folding line 7 of the extreme front box member may be kept at a particular height.

A box material removal unit 21 is located at a front and left side of hopper 15 on the mechanical body frame 12, note FIG. 2. The box material removal unit 21 includes a vacuum head 22 which faces against the front of the hopper 15 and a vacuum head driver which drives the vacuum head front and back.

The vacuum head 22 is equipped with a pair of head blocks, 24*a* and 24*b*. Each head block two pieces on the upper and lower portions of vacuum chucks 25. Each vacuum chuck 25 is equipped with a rubber vacuum pad 26 to enable the chuck to move front and back from the back side of the head blocks 24*a* and 24*b* in the direction of the said hopper 15. The vacuum pad 26 is moved by means of cylinder 40 which is placed on a front side of the head block 24*a* and 24*b*. A pair of guides 28 are positioned on both an upper and lower portion of the head block 24*a*. The other movable head block 24*b* moves along affixed to the guide rails 28. Right and left positioning of the head block 24*b* can be adjusted according to the size of the box material 1, and can be locked against the guide rails 28 by means of a lever which is not shown in drawing. Further, the guide rails 28 are slant from right to left, as viewed in FIG. 2, with the same angle as that of the hopper 15.

A vacuum head driver 23 has a pair of upper and lower transverse guide rails 29. One end of the guide rails are held by the mechanical body frame 12, and the other ends are supported by a support plate 31 which is placed on a back side of the mechanical body frame 12 through bracket 30, note FIG. 4. A moving stage 33 is mounted adjacent to the guide rails 29 through bearing 32 which enables the stage 33 to move along the direction of guide rails 29. Another head block similarly to 24*a*, is affixed to the moving stage 33 and moves front and back in one unit.

A link mechanism 34 is connected to the moving stage 33. A movable pair of longer links 35 are connected to a revolving fulcrum 36 at the center and movable shorter links 37 are connected to each end of the longer links 35. The ends of the movable shorter links are, connected at a revolving fulcurm 38, and the revolving fulcurm 38 is connected to the moving stage 33. The moving fulcurm 36 of the middle part is connected to a movable bearing 39 which is affixed to the upper guide rails 29. Revolving fulcrum 38 of the back end is connected to the upper end of the support plate 31.

An air cylinder 40, which operates by air pressure, is affixed to the side of the link mechanism 34. The cylinder is connected to one end to the mechanical body frame 12 and the front end of a piston rod 41 is connected to the revolving fulcrum 36. The ink mechanism 34 expands and contracts starting from the revolving fulcurm 38 according to the movement of the piston rod 41 of the cylinder 40, and operably moves stage 33 and the vacuum head 22 forward and backward.

A side plate 42 is installed continuously to the front end of the side plates 16*a* of the hopper 15 in front and back direction across the mechanical body 12. As shown in FIG. 3, lifting guide 43 is installed on the right side of the guide plate 42. The back end of the lifting guide 43 is shaped in arch to the right, as viewed in FIG. 3. The lifting guide 43 is shaped in arch to the right. The lifting guide 43 is movable by means of an air pressure cylinder, not shown, and the movement is between a position in parallel with the guide plate 42 and a position parallel with the front of the mechanical body 12, which is separated from the guide side plate 42 about an axis 44. The position of the axis 44 of the lifting guide 43 may be moved to the right and left of the mechanical body 12 according to the size of the box material 1, and this movement is achieved, again by means of an air pressure cylinder or alike.

Further, the space between the guide side plate 16*a* on the front of the hopper 15 and the lifting guide 43 is at the box forming position 45, from an outer position along the front and back of the box material 1 which meets the position of a base line 46 of the box forming position 45 as shown on FIG. 3. A bottom folding portion 51 and a tape head 61 are installed on the base line 46.

Figure 4:
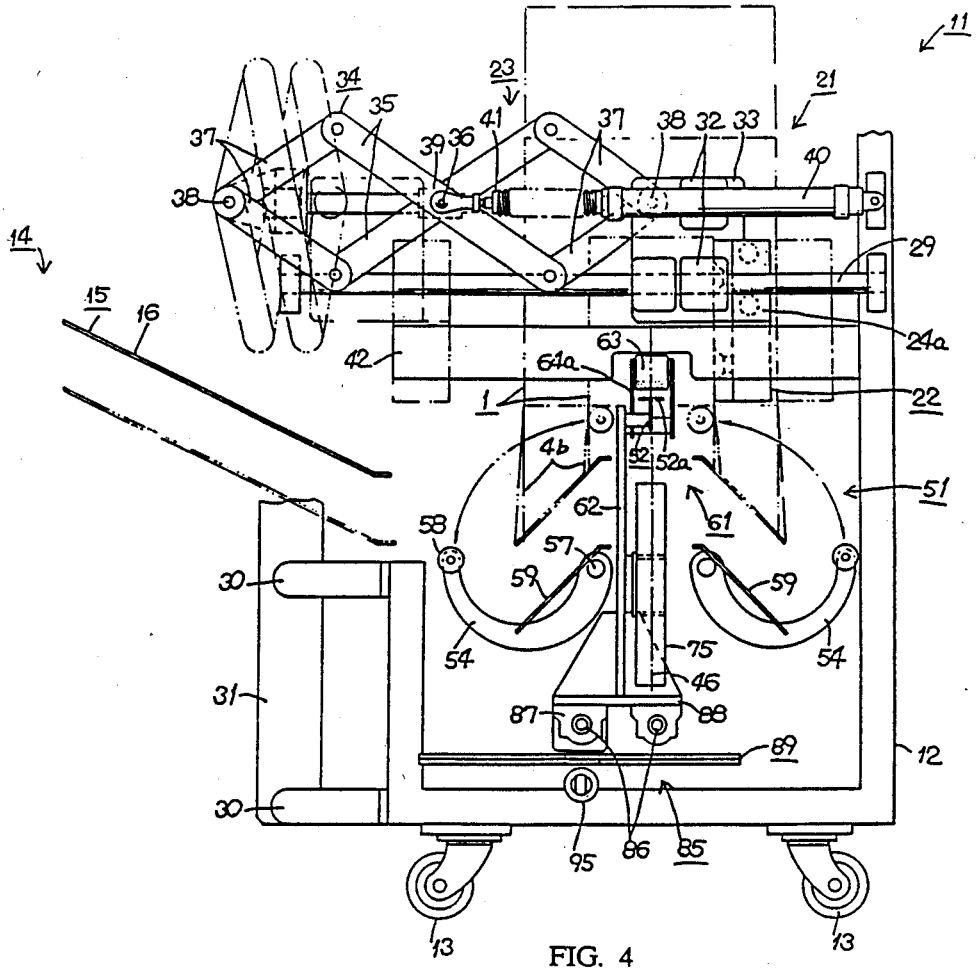
FIG. 4 is a side view of the box forming equipment shown in FIGS. 2 and 3.

The bottom folding part 51 is installed within the mechanical body frame 12 on a lower side of the said box forming position 45. The bottom folding part 51 has, as shown in FIGS. 2 and 4 folding levers 52, 53 that fold both inner folding edges 4*a* in a taping direction T of the box material 1. A pair of folding arms 54 fold both outer folding edges 4*b*, in the taping direction T, note the directional arrows in FIGS. 2 and 3.

Figure 5:
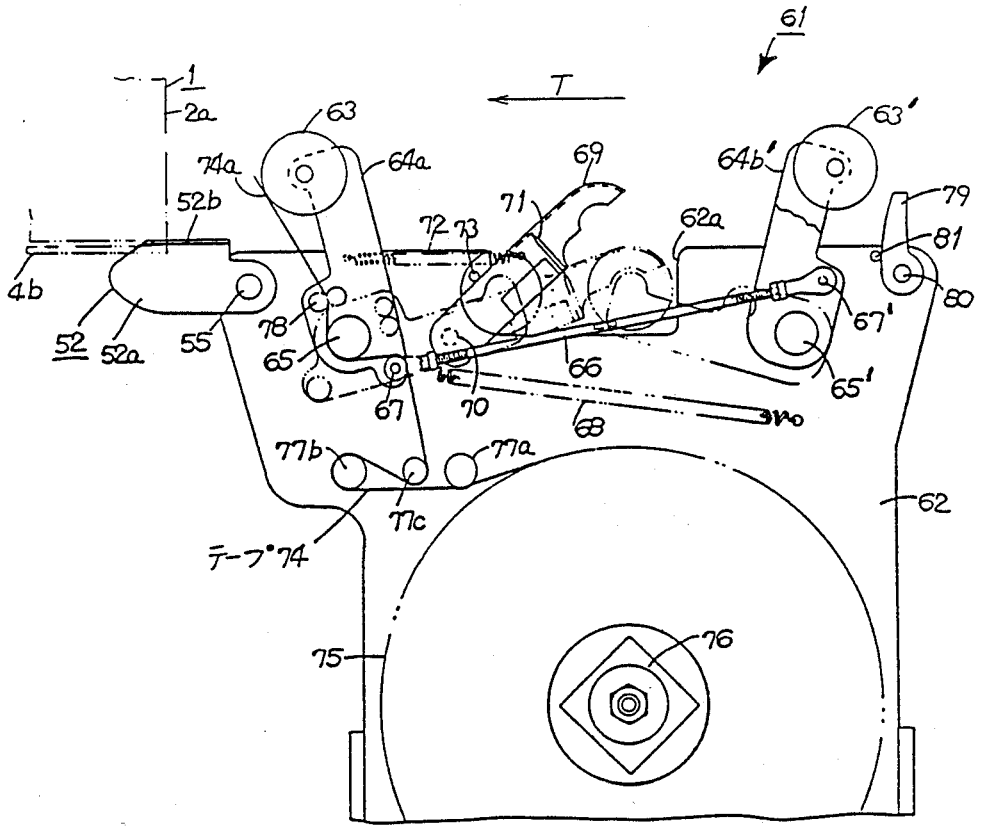
FIG. 5 is a detail front view of a tape head forming a portion of the subject box forming equipment.

The folding lever 52 as shown on FIG. 4 and FIG. 5 includes a thin pressure plate 52*b* which is mounted in a perpendicular posture with respect to a folding lever 52 is slanted from a front end of the plate 52*a* to the front edge of the pressure plate 52*b*. The lever 52*a* and the edge of the pressure plate 52*b* are both a part of a movable plate which is affixed via bearing 55 to the front end of a head portion 62 of a tape head 61.

Another movable folding lever 53 comprises a thin plate which is placed at a moving fulcrum of a revolving axis 56, note FIG. 2, on the outer position of side plate 42. The movable lever 53 is driven for rotation by a. cyliner, not shown, through air pressure and both folding levers 52 and 53 are placed at the base line 46.

The pair of the folding arms 54, as shown in FIG. 4 operate in an arc, with one end connected to a rotating axis 57 which is installed at symmetrical positions to the basic line 46. A movable roller 58 is affixed to a distal end of each folding arm and revolving motion is achieved by an air operated drive cylinder which is not shown in drawing. The roller 58 on both folding arms 54 operably moves up or down in a circular motion as depicted by phantom arrows in FIG. 4.

As shown in FIG. 4, the bottom folding part 51 of the subject box forming equipment has pair of the outer edge openers 59. Each outer edge opener is positioned to slant downwardly and outwardly in a direction symmetrical with respect to the base line 46 at a lower position of the box forming part 45. The edge openers 59 move up and down by means of air cylinders, which are not shown in drawing. The outer edge opener 59 climbs to open out each outer folding edge 4*b* of the box material 1 before the folding levers 52 and 53 fold each inner folding edges 4*a* of a box member 1 to be folded.

A movable tape head 61 is installed within said mechanical body frame 12 along a base line 46. The tape head 61, as shown in FIG. 5 is installed at the front side of a head base plate 62. This base plate 62 is affixed vertically to a moving stage 88 of a tape head driver 85 which is positioned in parallel with the mechanical body 12. A first taping arm 64*a* is movable and carriers a taping roller 63 at an upper part of the head base plate 62. The taping roller 63 is pivotably supported on axis 65. A second taping arm 64*b* carriers a taping roller 63' and is affixed to a moving fucrum of axis 65'. The taping arms 64*a* and 64*b* are connected to each end of a movable and adjustable length rod 66 through support axes 67, 67'. The arms 64*a* and 64*b* are able to jointly rotate by means of a spring 68 which is affixed between the first taping arm 64*a* and the head base plate 62, so as to rotate each taping roller 63 in the taping direction T. Rotation by the spring 68 is limited to the position shown in FIG. 5 in solid line by means of a stopper, not shown.

A movable front cutter holder 69 is mounted upon an axis 70 and is affixed to a front edge of the recessed part 62*a* at an upper center of the head base plate 62. The cutter holder 69 is located in a position close to the head base plate 62, which is independent from the rotation of the taping arms 64*a* and 64*b*. The cutter 71 is wider than the tape 74 and is positioned on the cutter holder 69 with a blade which faces upward and rotates in the taping direction by means of a spring 72 placed between the cutter holder 69 and head base plate 62. Rotation is limited by means of a stopper 73 which is raised from the head base plate 62.

The moveable tape drum 75 is installed at the center of the base 62. The tape drum 75 is changeable by fixing or releasing the center hole of the tape drum 75 to the rotating box 76 which is square shaped in cross section and affixed to the head base plate 62. The tape 74 is raised on front side in the taping direction T of the taping roller 64*a* through movable rollers 77*a*, 77*b* and 77*c* that are affixed to the head base plate 62. The first taping arm 64*a*, rotation axis 65 and a pair of the guide rollers 78 faces the adhesion side 74*a* of the tape 74 in the taping direction T.

The folding lever 52 is installed through the support axis 55 on the front side of the upper edge of the head base plate 62. A movable push lever 79 is installed upon a support axis 80 at the back side of the head base plate 62. The push lever 79 is biased to the taping direction T by means of a spring, not shown and rotating enforcement is limited by a stopper 81 which is raised on the head base plate 62.

A tape head driver 85 that drives the tape head 61 to move from right to left in the direction of the mechanical body 12, has a pair of guide axis 86 which is installed upon the mechanical body 12 with the same basic slant angle as that of the said hopper 15, note FIG. 2 and 3. A moving stage 88, with the head base plate 62, is installed upon the guide axes 86 through bearings 87 which enables the stage 68 to slide along the axes 86.

A link mechanism 89 is connected to the moving stage 88 and includes short rotating link arms 92 which connects to the ends of long links 90. The ends of the rotating shorter links 92 are connected to other ends of each link 90 of each link at a rotating and fulcrum 93. A left end rotating fulcrum 91 is connected to the moving stage 88. Each rotating fulcrum of a middle part 91 is connected to a rotating bearing 94 which is affixed to guide axis 86. The right end rotating fulcrum 93 is connected to the mechanical body 12. An air pressure cylinder 95 is installed at a position of the link mechanism 89 and the left end of the base of the cylinder 95 is connected to the said mechanical body 12, note FIG. 2. A piston rod 96 at a right end is connected to a lower side of the bearing 94 and the link mechanism 89 expands and contracts according to the movement of the piston rod 96 of the air cylinder 95, which in turn moves the stage 88 and the tape head 61.

An unloading guide plate 97 unloads a box 1 which has been formed into abox shape at the box forming station 45.

Box Forming Process

In forming a box with a closed base, as disclosed in FIGS. 1(*a*)–(*e*), adjustments are first made to the machine. In this connection and with reference to FIG. 3 the height of the hopper 15, the front and back position of the vacuum head 22 and the right and left position of the head block 24*b* of the vacuum head 22, the right and left position of the lifting guide 43 and a ready position of the tape head 61 is made. (These adjustment positions are the solid lined positions shown in each drawing).

The side board of the box material 1, which is folded and stored in the hopper 15, which faces the front, is placed against the vacuum head 22 and the side board 4*a* is against the lifting guide 43, as positioned by the two surfaces of the guides 16 and 17 and side board 16*a*.

The piston rod 41 is moved forward by operating the air cylinder 40 to send the moving stage 33 and the vacuum head 22 back via the link mechanism 34. When the back side of the vacuum head gets close to the extreme front of the box material 1 in the hopper 15, the cylinder 27 of each vacuum chuck is operated to send the vacuum pad 26 out from the head block 24*a*, 24*b* to press against the front of the box material 1.

The vacuum head 22 is moved forward by operating the cylinder 40 in a reverse manner. The box material 1 at the front from the hopper 15 is captured during movement of the vacuum head 22 to the front. The side board 2*a* of the box material touches the lifting guide 43, the box material 1 is folded between the lifting guide 43 and guide side plate 42 to form a box frame (as shown in FIG. 1(*b*)). Operation of the air cylinder 40 is stopped at the position where the center position of front and back direction of the box material 1 meets the base line 46.

The box material 1 is thereby raised to a rectangular shape with the inner folded edge 4*a* facing to right and left of the mechanical body 12 and in alignment with base line 46. The outer folded edge 4*b* faces front and back of the machanical body 12, held by continuous engagement by the vacuum chuck 25.

The outer folded edge opening plate 59 of the bottom folding part 51, expands, slightly outward, the outer folding edges 4*b*, and the folding lever 52, 53 rotate to the bottom side of the box material to fold both inner folded edges 4*a* of the box material 1 into the bottom area (as shown in FIG. 1(*c*)). Since the outer folded edge 4*b* is expanded slightly outward the inner folded edge 4*a* can be folded without touching, and interferring with the outer folded edge 4*b*.

Next the outer folded edge opening plate 59 extends down after folding the inner folded edge 4*a* of the box material into the bottom area of the box material 1.

The folding levers 52 and 53 are rotated to the bottom side of the box material 1 the folding arm 54 rotate up and fold the outer edges 4*b* of the box material into the bottom area of the box material 1 (as shown in FIG.

1(*d*)). Since the folded levers 52 and 53 are positioned between the ends of the outer folded edge **4*b***, both outer folded edges can be folded into abuttment with the ends in parallel.

Next the folding lever 54 rotates into position to the bottom side of the box material 1. Only the folding lever 53 is rotated to evacuate from the bottom side of the box material 1 and the pressure plate **52*b* is at an upper position with respect to both outer folded edges of the box material 1**.

The piston rod 96 is moved backward by operating the air cylinder 95 of the tape head driving part 85 and the moving stage 88 is moved forward and the tape head 61, through the link mechanism 89, tapes in the direction T.

By the forward movement of the tape head 61, the pressure plate of the folding lever 52 moves along the inside surface of the outer folded edge **4*b* of the box material 1. The end of the tape 74 touches the side board 2*b* of the box material 1 and the roller 63 of the first taping arm 64*a* presses the tape 74 to adhere it to the box edge surface. On the other hand, by touching the roller 63 to the side board 4*b* of the box material 1, the first taping arm 64*a* is pushed to rotate in the taping direction T. The second taping arm 64*b* rotates jointly to the taping direction T. Further, the touching position of the roller 63 of the first taping arm 64*a* changes from the side board 2*a* to the other folded edge 4*b* of the bottom of the box material. The tape 74 is adhered to the ends of both of the outer folded edge by the roller 63**.

By continuation of the movement of the tape head 61, pressed down by touching the cutter holder 69 to a corner of the bottom of the box material 1, the roller 63' of the second taping arm **64*b*' is rotated to the bottom area of the box material 1 and presses the tape 74 to the outer folded edge 4*b*. Further push lever 79 touches the corner of the bottom area of the box material 1** and rotates in a counter direction of the taping direction T.

While the tape head 61 is moving over the bottom area of the box material 1, the tape 74 is taken out from the tape drum 75 and adhered to both edges of the outer folded edge **4*b* of box material 1 by means of the roller 63 of both taping arms 64*a*, 64*b***.

The pressure plate **52*b* of the folding lever is positioned at an upper surface of both outer edge 4*b* of the box material 1 and floating caused by the taping roller 63 etc. of the box material 1** can be avoided.

When another size of the box other than the size of the box material shown in solid line in the FIG. 3 is applied for forming, for example, as shown in FIG. 3 in imaginary lines, like a large sized box, adjust the height of the hopper 15 so as to meet the folding line 7 of the box material 1. Adjust the position of the back and front direction of the vacuum head 22 so as to meet the center of the front and back direction of the box material with the base line 46 when the box material 1 is raised to the box frame and the right and left direction of the head block **24*b* and the vacuum head 22. Adjust the right and left direction of the lifting guide 43 and adjust the ready position of the tape head 61. Then the box can be formed in the said process. These position adjustments may be made automatically by date input of the box material 1**.

To raise the box frame at the box making position 45 move the tape head 61 with the tape 75 along the box material 1 of which inner folded edge **4*a* and the outer folded edge 4*b* are folded into the bottom area. The tape 74 is adhered to the said box forming position 45. The size of the box forming equipment 11** can be small.

Link mechanisms 34 and 39 move the vacuum head 22 and the tape head 61, through movement of the piston rod 41 and 96 of each cylinder is amplified and transferred to the vacuum head 22 and the tape head 61. Accordingly, small and inexpensive cylinders 40, 95 can be used, thus the subject box forming equipment 11 can be small sized and relatively inexpensive.

By this invention, the box frame and the inner folded edge and the outer folded edge of the box material are folded into the bottom area, the tape head 61 passes through the bottom area of the box material 1, at first, the roller 63 of the first taping arm **64*a* releases from the bottom of the box material 1, but since the front of the second taping arm 64*b* remains on the bottom of the box material 1, the first taping arm 64*a* remains at the lowered position. Then, the cutter holder 69 releases from the box material 1, and the cutter holder 69 jumps up by means of the spring 72 and cuts the tape 74 which is between taping arm 64*a* and 64*b*. Then, the end of the cut tape 74 is adhered to the side 2*a* of the box by the second taping arm 64*b* roller 63, to the both outer folded edge 4*b* and by changing the touching position of the roller 63, of the second taping arm 64*b* against the box material 1 from the both outer folded edge 4*b* to the side board 4*a*, by pulling up the second taping arm 64*b*, the end of the tape 74 is adhered to the side board 4*a* (as shown in FIG. 5**(*e*)). Further, by releasing the tape head 61 from the bottom area of the box material 1 completely, the push lever 79 raises up.

After adhesion of the tape 74, the folding lever 52 is rotated downward, and, releases the vacuum holding of the box material 1 by means of the vacuum chuck 26. The vacuum pad 26 is sent backward into the head block **24*a*, 24*b*, then, the lifting guide 43 is loosened by rotating to the front side of the mechanical body 12. In this situation, the box material 1 is placed on the folding arm 54 and held between the head block 24*a*, 24*b* and the guide side plate 42**.

Operation of the air cylinder 95 in a direction opposite to the said operation to directs the piston rod 96 forward, move the moving stage 88 and the tape head through the link mechanism 89 in an opposite direction of the taping direction T. By reversing movement of the tape head 61, the push lever 79 is pushed out touching the box material 1, during the pushing process, the box material 1 is transferred onto the release guide plate 97, and releases out to the mechanical body 12. Then, the operation of the cylinder 95 is stopped when the tape head 61 reaches the initial ready position.

The machine is returned to the ready position by rotating the folding arm 54 down during the movement of the tape head and adhereing the tape onto the outer folded edges of the box material to form a box. Thus the length of the equipment in the taping direction can be short, and the mechanism which holds the box material is kept within the box frame to be moved. The total size of the equipment becomes smaller and the cost of fabrication of the machine can be reduced.

In describing the invention, reference has been made to preferred embodiments and illustrative advantages of the invention. Those skilled in the art, however, and familiar with the instant disclosure of the subject invention, may recognize additions, deletions, modification, substitutions and/or other changes which will fall within the purview of the subject invention and claims.

What is claimed is:

1. A compact box forming apparatus for erecting from a folded, generally flat, storage condition to a generally rectangular erect condition a box having opposing end walls and opposing side walls and at least opposing bottom end edges and opposing bottom side edges connected to the opposing end walls and opposing side walls respectively and the bottom edges being operable to be folded into a bottom surface of the box with a bottom seam, said box forming apparatus comprising:

a frame;

means connected to said frame for raising a box material from a folded, generally flat storage condition into a generally rectangular shape with at least open, and mutually opposing, bottom end edges and open, and mutually opposing, bottom side edges at a box forming station;

means connected to said frame for folding the open, mutually opposing, bottom end edges toward each other at said box forming station;

means connected to said frame for folding open, mutually opposing, bottom side edges toward each other at said box forming station following folding of the open, mutually opposing, bottom end edges toward each other; and means connected to said frame for applying box adhering tape onto the box along the bottom seam, said means including reciprocating tape means for being driven beneath the box with its folded bottom end and side edges positioned at said box forming station and for applying a strip of adhering tape, at said box forming station, said reciprocating tape means beginning movement at an initial position at least partially upon an end wall of the box, said reciprocating tape means continuing movement along a bottom seam extending between the opposing bottom side edges and upon each of the opposing bottom side edges, and completing its movement at least partially upon an opposing end wall of the box to secure the bottom of the box in an erect condition and said reciprocating tape means returning to said initial position.

2. A compact box forming apparatus as defined in claim 1 and further comprising:

means connected to said frame for operably engaging the opposing bottom side edges and directing the opposing bottom side edges away from each other prior to activation of said means for folding the mutually opposing bottom end edges toward each other at said box forming station such that said opposing bottom side edges will not interfere with folding of the mutually opposing bottom end edges toward each other.

3. A compact box forming apparatus as defined in claim 1 and further comprising:

pressure plate means connected to said reciprocating tape means and being carried in advance of a strip of a tape being applied to the bottom the box, said pressure plate means being T-shaped in cross section, having a leg and a normally extending crossing member, and being operable such that the top crossing member of said T-shape extends along inner edge surfaces of the mutually opposing bottom side edges of the box and the leg extends through a seam between the opposing bottom side edges as tape is applied to the outer edge surfaces of the opposing bottom side edges to prevent upward bowing of the box edges as the tape is being applied to the bottom of the box.

4. A compact box forming apparatus as defined in claim 1 and further comprising:

means for driving said reciprocating tape means beneath an erected box positioned at said box forming station, said means for driving including, a piston and cylinder assembly connected at one end to said frame, and a link mechanism connected between the other end of said piston and cylinder and said reciprocating tape means which amplifies the driving force of said piston and cylinder assembly.

5. A compact box forming apparatus as defined in claim 4 wherein said reciprocating tape means comprises:

a carrier mounted upon said frame for reciprocation with respect to said frame and box forming station;

means connected to said carrier for mounting and dispensing a spool of box adhering tape;

a first taping arm pivotally connected to said carrier;

a first taping roller pivotally connected to a distal end of said first taping arm for rolling an adhering tape onto at least a portion of the front end wall of the box and the bottom seam of the box;

a second taping arm pivotally connected to said carrier and positioned behind said first taping arm, a second taping roller pivotally connected to a distal end of said second taping arm to insure adhering contact of the tape onto the bottom seam of the box and at least partially up the back end wall of the box; and tape cutting means pivotally connected to said carrier between said first taping arm and said second taping arm for cutting a length of tape necessary to close the end of the box as said tape means is driven beneath the box at said box forming station.

6. A compact box forming apparatus as defined in claim 5 wherein said reciprocating tape means further comprises:

a push lever pivotally connected downstream of said second taping arm for ejecting an erected and taped box from said box forming station upon completion of a taping operation and retraction of said tape means from said box forming station.

7. A box forming apparatus as defined in claim 1 wherein said means for raising includes: a hopper which is slanted down to the direction of a forming station in which more than two boxes may be stacked.

* * * * *